US006439391B1

(12) United States Patent
Seyffert

(10) Patent No.: US 6,439,391 B1
(45) Date of Patent: Aug. 27, 2002

(54) VIBRATORY SEPARATOR WITH MATERIAL HEATER

(75) Inventor: Kenneth Wayne Seyffert, Houston, TX (US)

(73) Assignee: Tubo Scope I/P, Inc., Houston, TX (US)

( * ) Notice: Subject to any disclaimer, the term of this patent is extended or adjusted under 35 U.S.C. 154(b) by 0 days.

(21) Appl. No.: 09/691,569

(22) Filed: Oct. 18, 2000

Related U.S. Application Data

(62) Division of application No. 09/166,063, filed on Oct. 2, 1998, now Pat. No. 6,179,128.

(51) Int. Cl.[7] ..... B07B 1/46

(52) U.S. Cl. ..... 209/238; 209/309; 209/315; 209/11

(58) Field of Search ..... 209/11, 315, 319, 209/399, 403, 405, 409, 309, 238

(56) References Cited

U.S. PATENT DOCUMENTS

| | | | | | |
|---|---|---|---|---|---|
| 516,673 | A | | 3/1894 | Wilson | 209/413 |
| 777,317 | A | | 12/1904 | Traylor | 210/384 |
| 1,073,825 | A | | 9/1913 | Spring | 209/403 |
| 1,462,804 | A | | 7/1923 | Evans | 209/398 |
| 1,997,740 | A | | 4/1935 | Nickerson | 209/403 |
| 2,274,700 | A | | 3/1942 | Jenks | 209/408 X |
| 2,315,055 | A | | 3/1943 | Heller | 209/400 |
| 2,723,032 | A | | 11/1955 | Gisler et al. | 209/401 |
| 2,825,461 | A | * | 3/1958 | Hannon | 209/238 |
| 2,985,303 | A | | 5/1961 | Wright | 209/405 |
| 3,176,843 | A | | 4/1965 | Hoskins et al. | 209/403 |
| 3,483,912 | A | | 12/1969 | Andrews | 209/403 X |
| 3,666,095 | A | | 5/1972 | Krynock et al. | 209/254 |
| 3,666,277 | A | | 5/1972 | Hubach et al. | 277/166 |
| 4,033,865 | A | | 7/1977 | Derrick, Jr. | 209/275 |
| 4,040,951 | A | | 8/1977 | Cole | 209/408 |
| 4,140,630 | A | | 2/1979 | Scarlett et al. | 209/313 |
| 4,248,701 | A | | 2/1981 | Wenzel | 209/363 |
| 4,257,168 | A | * | 3/1981 | Carroll et al. | 209/238 X |
| 4,303,509 | A | | 12/1981 | Lilie | 209/403 |
| 4,319,993 | A | | 3/1982 | Krause | 209/315 |
| 4,350,591 | A | | 9/1982 | Lee | 210/384 |
| 4,380,494 | A | | 4/1983 | Wilson | 209/319 |
| 4,390,420 | A | | 6/1983 | Tenhaaf | 209/403 |
| 4,420,391 | A | | 12/1983 | Sharki | 209/403 |
| 4,457,510 | A | | 7/1984 | Johnson et al. | 209/403 |
| 4,457,839 | A | | 7/1984 | Bailey | 209/234 |
| 4,575,421 | A | | 3/1986 | Derrick et al. | 209/397 |
| 4,655,907 | A | | 4/1987 | Ando | 209/404 |
| 4,819,809 | A | | 4/1989 | Derrick | 209/275 |
| 4,820,407 | A | | 4/1989 | Lilie | 209/397 |

(List continued on next page.)

FOREIGN PATENT DOCUMENTS

DE 870935 C 3/1953

OTHER PUBLICATIONS

Screen Heating Attachments, Coal Age, vol. 67, No. 7, Jul. 1962, p. 270.

Int'l Search Report, PCT/GB99/00516, PCT counterpart of this case 09/166,063.

*Primary Examiner*—Tuan N. Nguyen
(74) *Attorney, Agent, or Firm*—Guy McClung

(57) ABSTRACT

A vibratory separator apparatus for separating components from a fluid material stream fed to the vibratory separator apparatus, the vibratory separator apparatus, in certain aspects, having separator apparatus for separating components of the fluid material stream, and heating apparatus for heating the fluid material stream. A screening system with a screen mounting basket, at least one screen mounted on the basket, and heating apparatus for heating the at least one screen. Methods are disclosed for using such apparatuses and systems

5 Claims, 10 Drawing Sheets

U.S. PATENT DOCUMENTS

| | | | | |
|---|---|---|---|---|
| 4,882,054 | A | 11/1989 | Derrick et al. | 210/389 |
| 4,911,834 | A | 3/1990 | Murphy | 210/167 |
| 5,028,324 | A | 7/1991 | Teinert | 210/232 |
| 5,037,536 | A | 8/1991 | Koch et al. | 209/325 |
| 5,221,008 | A | 6/1993 | Derrick, Jr. et al. | 209/269 |
| 5,246,116 | A | 9/1993 | Kirk | 209/3 |
| 5,299,692 | A | 4/1994 | Nelson et al. | 209/2 |
| 5,332,101 | A | 7/1994 | Bakula | 209/403 |
| 5,346,053 | A | 9/1994 | Dorn | 198/399 |
| 5,392,925 | A | 2/1995 | Seyffert | 209/405 |
| 5,417,793 | A | 5/1995 | Bakula | 156/308.2 |
| 5,417,858 | A | 5/1995 | Derrick et al. | 210/388 |
| 5,417,859 | A | 5/1995 | Bakula | 210/388 |
| 5,456,365 | A | 10/1995 | Jansseus et al. | 209/403 |
| 5,490,598 | A | 2/1996 | Adams | 209/401 |
| 5,598,930 | A | 2/1997 | Leone et al. | 209/403 |
| 5,673,797 | A | 10/1997 | Bakula et al. | 209/392 |
| 5,690,826 | A | 11/1997 | Cravello | 210/384 |
| 5,775,831 | A | 7/1998 | Mullenberg | 403/337 |
| 5,783,077 | A | 7/1998 | Bakula | 210/388 |

* cited by examiner

FIG. 6C
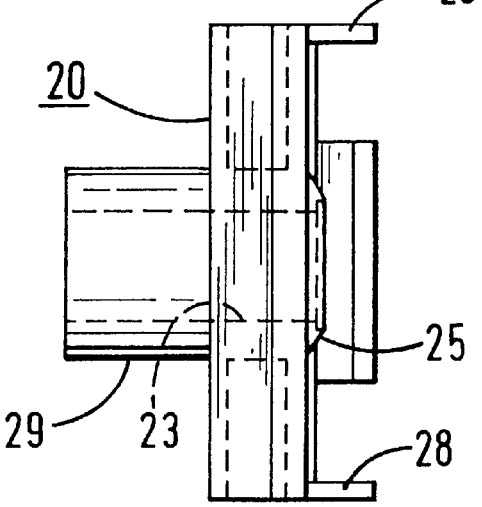
FIG. 6D
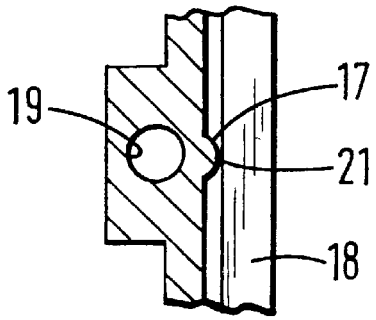
FIG. 10C
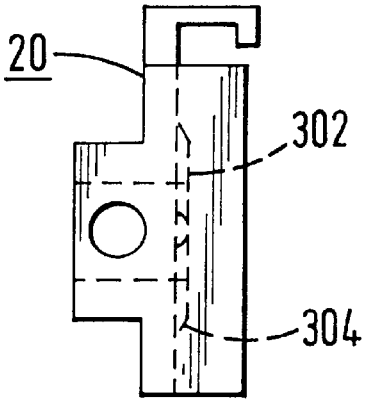
FIG. 10D
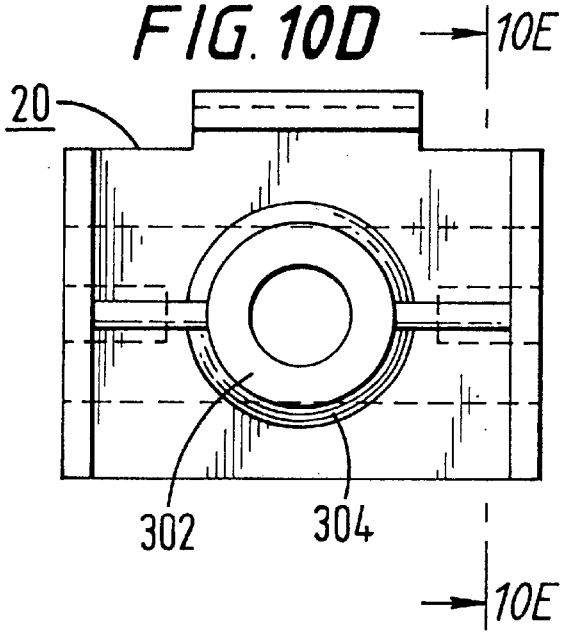
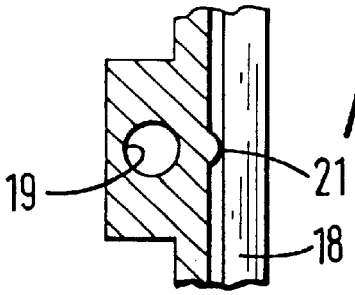
FIG. 10E

VIBRATORY SEPARATOR WITH MATERIAL HEATER

Related Application

This is a division of U.S. application Ser. No. 09/166,063 filed Oct. 2, 1998, now U.S. Pat. No. 6,179,128 incorporated fully herein for all purposes.

BACKGROUND OF THE INVENTION

1. Field of the Invention

This invention is directed to vibratory separators and to such separators with heating appratus for heating material to be treated.

2. Description of Related Art

The prior art discloses a variety of devices and apparatuses for securing a screen to a vibratory screening apparatus. Many of the prior art systems employ a simple bolt, nut, and plate combination, with or without shock absorbing material. Tightening and loosening of the nut provides tension adjustment. Exemplary prior art patents include, but are not limited to, U.S. Pat. Nos. 4,303,509; 5,332,101; and 5,392,925.

U.S. Pat. No. 5,332,101 discloses a screen tensioning structure that includes body members with a cam arrangement whose movement creates a pulling effect when cam followers slide up camtracks. Certain commercially available embodiments require a special wrench to turn a movable adjustment nut. Often, the nut can only be effectively adjusted when the structure is in an unlocked position. With some prior art devices sliding surfaces must be lubricated regularly, otherwise the surfaces gall making high torque necessary, which in turn requires a high wrench load which can result in a bent tension bolt.

Certain prior art devices can result in insufficient tension on a screen when their springs collapse (take a set) reducing the total tension load produced by the spring. Many times the only way to then achieve proper tension on a screen is to collapse the spring completely and torque the spring adjusting nut.

There has long been a need for an efficient and effective screen tensioning clamp apparatus. There has long been a need for such an apparatus that can be used with existing vibratory system screen mounts without requiring changes and alternations to the vibratory system. There has long been a need for such an apparatus which is adjustable while in a locked position. There has long been a need for such an apparatus that reduces misalignment between the apparatus and structural members of the vibratory system.

SUMMARY OF THE PRESENT INVENTION

The present invention discloses, in certain aspects, a vibratory separator apparatus for separating components from a fluid material stream (e.g., but not limited to drilling fluid) fed to the vibratory separator apparatus, the vibratory separator apparatus for separating components of the fluid material stream, and heating apparatus for heating the fluid material stream.

The present invention discloses, in certain embodiments, a screening system with a screen mounting basket, at least one screen mounted to the basket, at least one clamp system clamping the at least one screen to the screen mounting basket,and heating apparatus for heating the at least one screen.

The present invention, in certain embodiments, is a screen tension clamping apparatus that has dual locking links rotatably connected to each other that selectively cam "past center" or "over center" to provide a stable locked mode for the apparatus. A front grip plate is rotatably mounted, in these embodiments, to a first locking link. The grip plate is releasably securable to a typical side mount on a vibratory screen system. The second locking link has, in one aspect, a swivel rotatably mounted to it and a portion of a bolt extends through the swivel, both links, and the front grip plate. A further portion of the bolt extends through the side mount and projects beyond a screen tension rail or screen mounting member. An end of the bolt abuts the tension rail so that tightening the nut at the bolts other end increases tension on the screen. Such tightening can be done after the dual locking links are moved to contact each other in a locked (yet releasable) position.

Typical wrench flats, bosses, or recesses are provided on each of the locking links, in certain embodiments so that off-the-shelf wrenches may be used to move the links apart and together. To provide spring tension on the bolt, a spring or springs may be used between the nut and the swivel; between the grip plate and an enlarged bolt portion; or at any suitable location int he apparatus. In one aspect, spring discs (e.g. one, two, three, four, or more) are used between the nut and the swivel. Such spring discs or flange belleville springs are commercially available.

The swivel permits the links to align with the bolt to reduce or eliminate binding of the grip plate with the side mount of a vibratory screen apparatus.

Certain screens with integral tension rails or side members can also be secured with an apparatus according to the present invention.

The present invention, in certain aspects, provides a vibratory screen apparatus which includes; a basket for mounting of one or more screens; one or more screens releasably mounted to the basket with any tension clamping devices described above or herein; and one or more vibratory devices for vibrating the basket and/or screen.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures.

It is, therefore, an object of at least certain preferred embodiments of the present invention to provide new, useful, unique, efficient, nonobvious screening systems with heating apparatus for heating a fluid material stream to be treated by the screeing system, vibratory separator apparatus with such heating apparatus, and methods of their use.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 6B is an end view and FIG. 6C is a bottom view of the plate of FIG. 6A. FIG. 6D is a partial side view of the plate of FIG. 6A.

FIGS. 10A–10E are view of a system according to the present invention like those of FIGS. 1A, 1B, 6A, 6B and 6D, respectively.

DESCRIPTION OF EMBODIMENTS PREFERRED AT THE TIME OF FILING FOR THIS PATENT

Figure 1A:
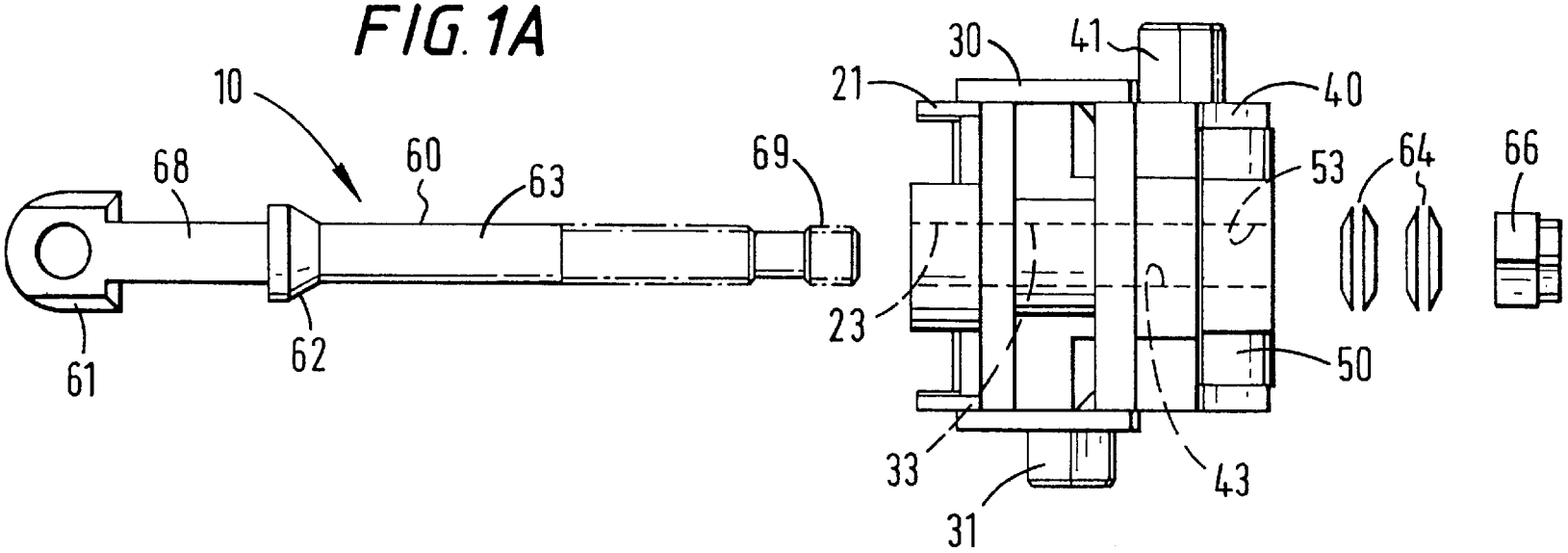
FIG. 1A is a top view of a clamping apparatus according to the present invention.
Figure 1B:
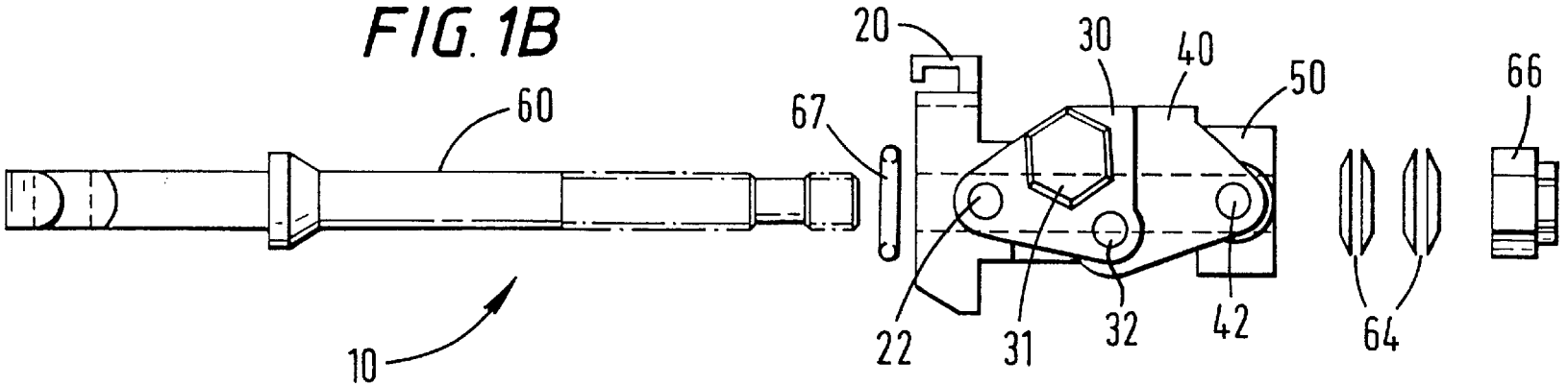
FIG. 1B is a side view of the apparatus of FIG. 1A.
Figure 1C:
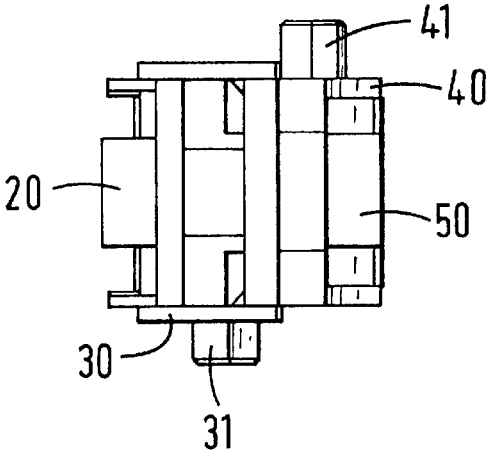
FIG. 1C is a top view of part of the apparatus of FIG. 1A.
Figure 1D:
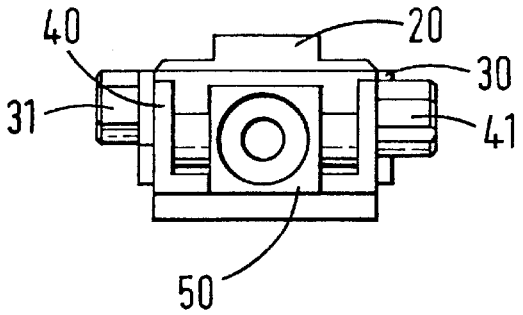
FIGS. 1D and 1F are end views of the apparatus of FIG. 1C.
Figure 1F:
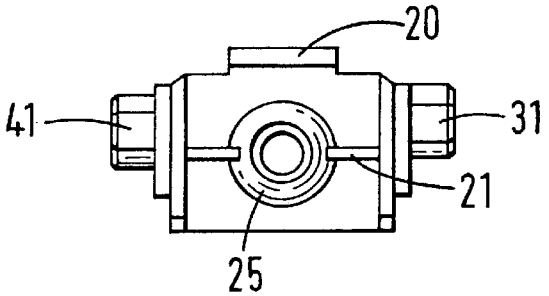
Figure 1E:
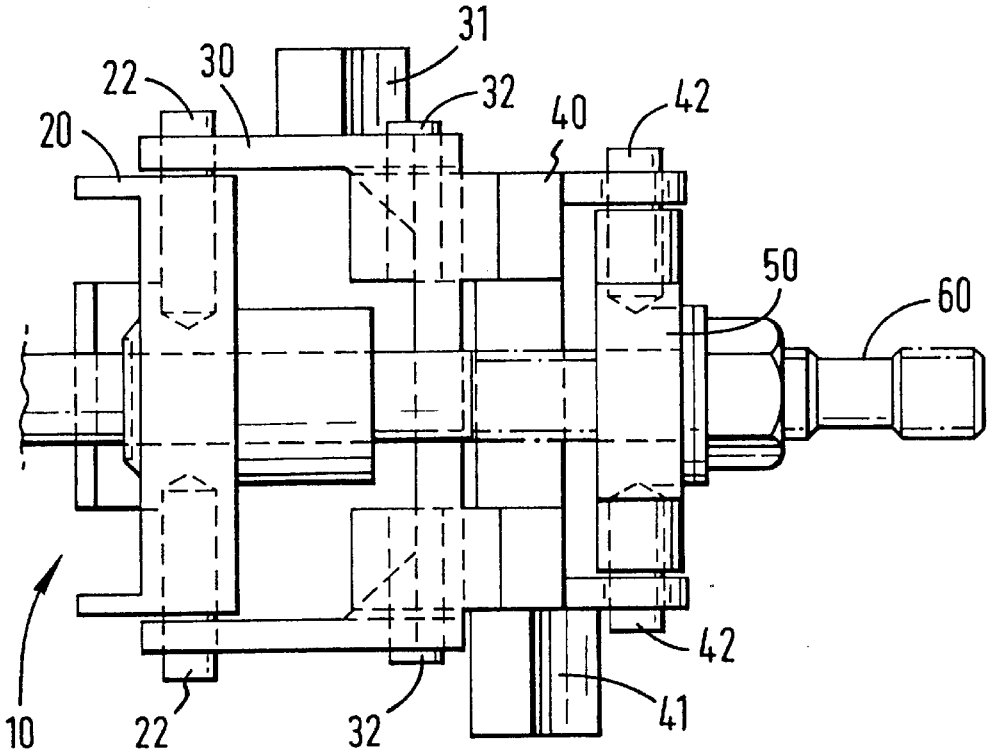
FIG. 1E is a bottom view of part of the apparatus of FIG. 1A.

Referring now to FIGS. 1A–1F a device 10 according to the present invention has a bolt 60 that extends through a plate 20, a first link 30, a second link 40 and a swivel 50. A nut 66 threadedly mates with threads 69 to releasably hold the bolt 60 in position.

The bolt 60 has a shaft portion 63 that extends movably through a channel 23 in the plate 20 (see FIGS. 6A–6D). On a front side of the plate 20 a raised portion 25 facilitates holding a head of the bolt 60 in a position to more easily engage a tension rail. An O-ring or other sealing member 67 (see FIG. 1B) is, optionally, disposed in a recess 23 within the raised portion 25 and seals against portion 62 of the bolt 60.

An optional cylinder 29 projects from the rear side of the plate 20 and the channel 23 extends all the way through the plate 20 to the rear end of the cylinder 29. As will be discussed below, the rear side of the cylinder 29 provides a stop against which movement of the swivel 50 is stopped.

Arms 28 and arm 24 releasably encompass a side mount plate 18 (see FIGS. 2B, 2D), and a lip 27 extends releasably down in front of the side mount plate 18 which is secured to the basket side wall of a basket of a vibratory screen device (not shown).

A ridge 21 across the front of the plate 20 is sized, configured and disposed for pivoting against a flat part of the side mount plate 18. Alternatively, one or more raised portions or bumps on the front of the plate 20 may be used for this purpose, including, but not limited to, two spaced apart nodules one on either side of the raised portion 25 or a series of three or more nodules across the plate. The ridge 21 allows the assembly to align itself with a tension bolt and inhibits binding of the bolt against parts it may contact.

Pinion holes 19 are located on two sides of the plate 20 for pinions 22 extend through the first link 30 and into the holes 10 to movably connect the plate 20 and the first link 30. A corresponding recess or hole in the side mount plate 18 can accommodate the raised portion 25. A seal member, e.g. an O-ring, may be used to seal the portion 25/plate 18 interface. Alternatively the plate 20 is formed integrally of the link 30. Pinions may be made of any suitable material, including metal, including, but not limited to hardened steel or stainless steel.

The first link 30 as shown in FIGS. 1A, 2A, 4A and 4B has arms 36 with holes 34 therethrough for the pinions 22. A bar 38 extends between and interconnects the arms 36. A rear side of the bar 38 is movable to abut the arm 24 of the plate 20, but the bar 38 may be sized and configured so that it can pass above the arm 24. The bar 38 in the embodiment shown is spaced apart from the cylinder 29 of the plate 20 by the arms 36 so that the bar 38 does not touch the cylinder 29. Alternatively a recess may be provided in the bar 38 to accommodate the cylinder 20 and the cylinder 29 may be extended further (further than as shown inn FIGS. 1A, 2A) to the rear. Alternatively, the swivel 50 may, in other embodiments, be deleted and replaced with a block or member that does not swivel or pivot. In aspect in which the cylinder 29 is not used, a bolt has more freedom of movement, e.g. for alignment.

A wrench boss 31 projects from one of the arms 36 for use with any typical known commercially available wrench. Alternatively, a hex recess for an Allen wrench or "star" recess for a corresponding type wrench may be used. Also, a simple hole or projecting surface may be provided for engagement manually, by a hook, or by other similar devices. Alternatively, wrench bosses, engagement bosses or bars, and/or wrench recesses can be provided on both arms 36.

Pinions 32 extend through holes 35 to movably connect the first link 30 to the second link 40. As discussed below, a rear surface 37 of the bar 38 serves as a stop for a corresponding surface of the second link 40. With the bolt 60 removed, the first link 30 can rotate about the pinions 22 past a longitudinal axis of the cylinder 29.

The second link 40 (see FIGS. 1A, 2A, 5A and 5B) has two arms 48 with holes 44 therethrough for the pinions 32. The arms 48 are disposed within the arms 36 of the first link 30. A bar 47 interconnects and extends between the arms 48. A front surface 49 of the bar 47 is movable as the arms 48 rotate about the pinions 32 to abut and stop against the rear surface 37 of the first link 30.

A wrench boss 41 is engageable by a known wrench to move the second link 40. The wrench boss 41 may be replaced and/or used with any of the alternatives discussed above for the wrench boss 31 of the first link 30.

Rear arms 45 have holes 46 for pinions 42 that movably connect the swivel 50 to the second link 40. A cut out portion 41 in the bar 47 provides a space within which part of the swivel 50, as discussed below, can rotate.

FIGS. 1A, 1D, 1E, 3A and 3B show the swivel 50. The swivel 50 has two arms 51 with holes 56 therethrough for the pinions 42. A hole 54 in a member 57 accommodates the belt 60 and an inner surface 58 of a recess 17 provides a stop for the nut 66. Alternatively, depending on the size of the nut 66 and the recess 52, a rear surface of the member 57 can serve as a stop for the nut 66. The surface 49 of the second link 40 may be slanted (downwardly from left to right in FIG. 5B) to permit full 360° rotation of the swivel 50 about the pinions 42 but this degree of rotation is not required. In other aspects only that amount of rotation is needed that allows collapse of the device. The hole 54 may have a diameter slightly larger than the outer diameter of the bolt 60 to permit some movement of the bolt 60 with respect to the walls of the hole 54.

Figure 2A:
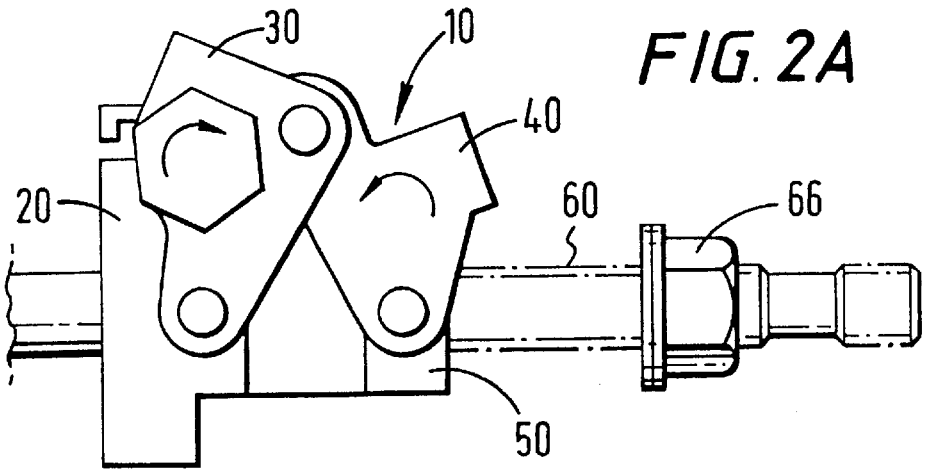
FIGS. 2A and 2B show the apparatus of FIGS. 1A in a collapsed unlocked position.
Figure 2B:
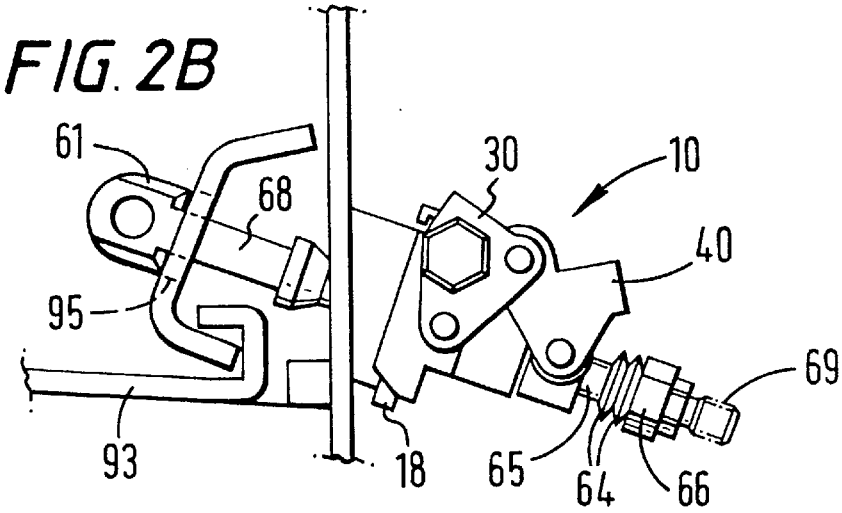
Figure 2C:
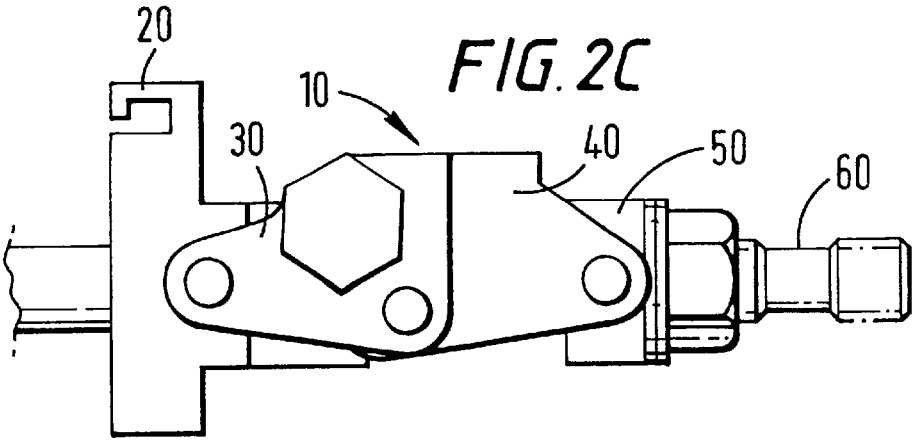
FIGS. 2C and 2D show the apparatus of FIG. 1A in an extended, closed, locked position.
Figure 2D:
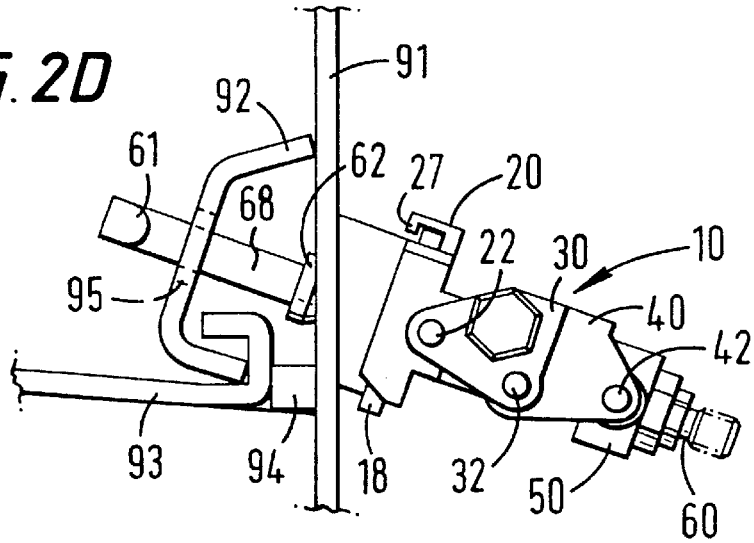
Figure 3A:
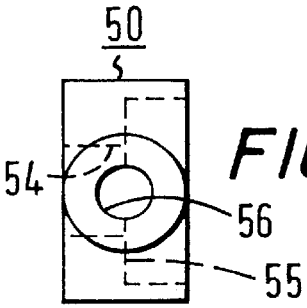
FIG. 3A is a side view in cross section of a swivel of the apparatus of FIG. 1A.
Figure 3B:
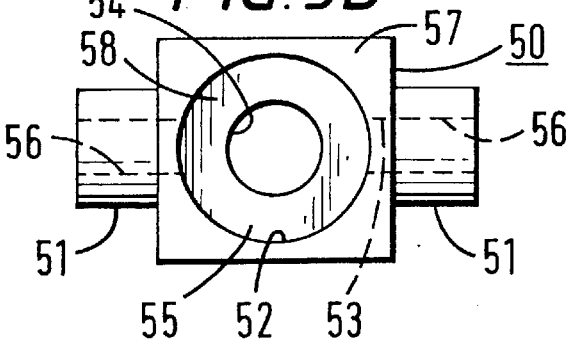
FIG. 3B is an end view of the swivel of FIG. 3A.
Figure 4B:
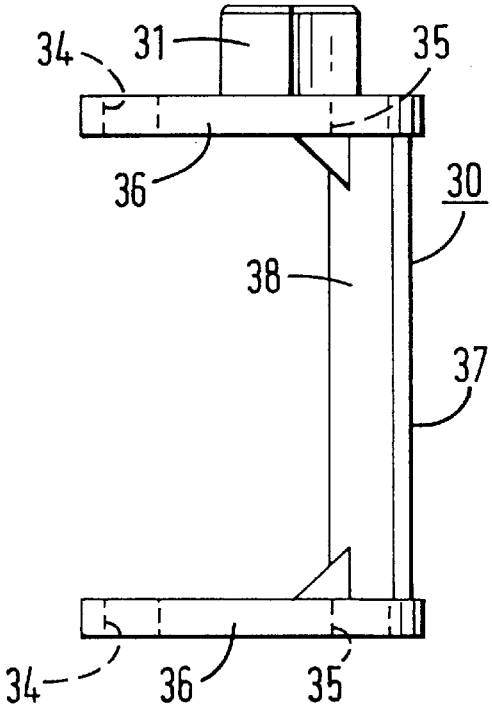
FIG. 4B is a bottom view of the link of FIG. 4A.
Figure 4A:
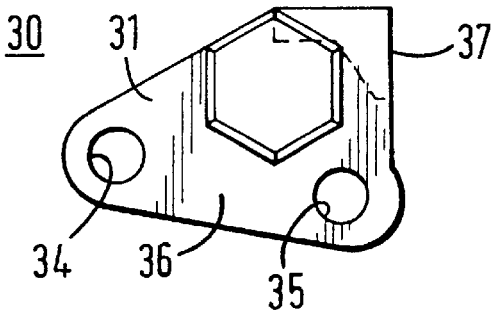
FIG. 4A is a side view of a link of the apparatus of FIG. 1A.
Figure 5A:
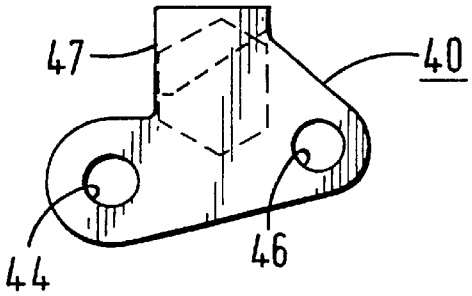
FIG. 5A is a side view of a link of the apparatus of FIG. 1A.
Figure 5B:
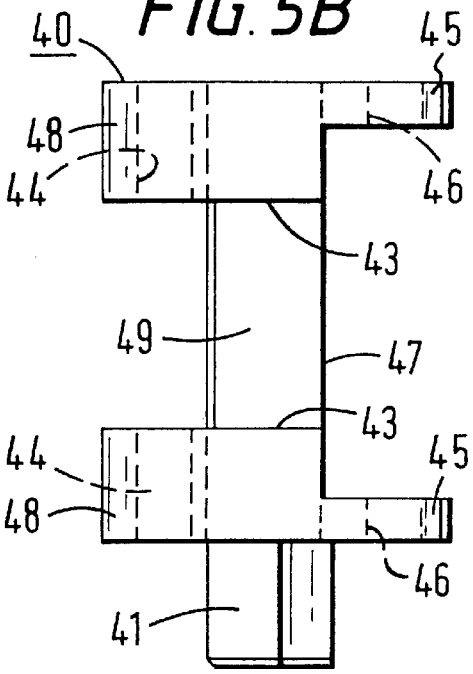
FIG. 5B is a bottom view and FIG. 5C is an end view of the link of FIG. 5A.
Figure 5C:
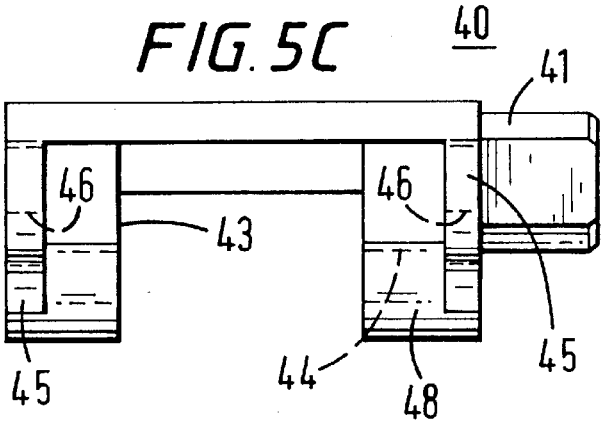
Figure 6A:
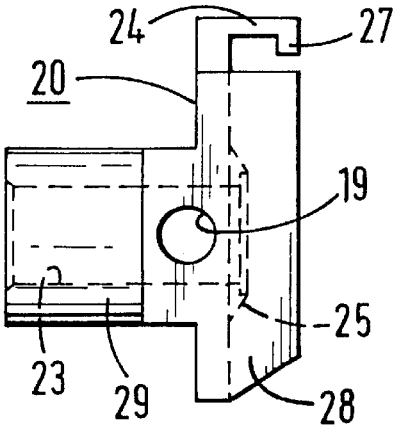
FIG. 6A is a side view partially in cross-section of a grip plate of the apparatus of FIG. 1A.
Figure 6B:
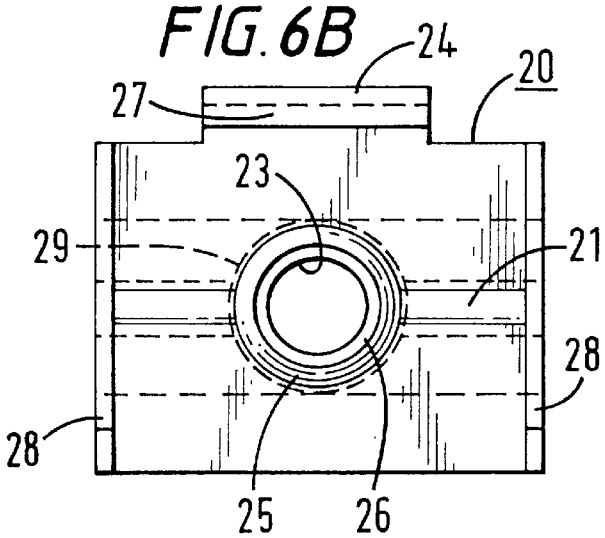

As shown in FIGS. 2B and 2D an enlarged bolt end 61 extends through a hole 95 in and engages an inner surface of a tension rail 92. The enlarged bolt portion 62 abuts an inner surface of a basket sidewall 91 of a screen-holding basket of a vibratory screening apparatus. The lip 27 of the plate 20 engages the side mount plate 18. A screen 93 is engaged by the tension rail 92 and abuts a stop 94 secured to or formed integrally of the basket sidewall 91.

As shown in FIGS. 2A and 2B, the apparatus 10 is in a collapsed open position and the screen 93 has not been completely tensioned by the combination of the apparatus 10 and the parts of the vibratory screening apparatus. The enlarged end 61 of the bolt 60 has been inserted through the hole 95 but the bolt 60 has not been turned to prevent the bolt end 61 from exiting the hole 95 (to the right in FIG. 2B). A shaft portion 68 of the bolt 60 is in the hole 45. The links 30 and 40 are in the open collapsed position. Arrows on the links in FIG. 2A indicate how the links will be moved to go to the closed extended position of FIGS. 2C and 2D. The bolt 66 has not been tightened against the swivel 50 in FIGS. 2A and 2B.

As shown in FIGS. 2C and 2D, the end 61 of the bolt 60 has been turned 90 degrees, releasably holding the bolt end against an inner surface of the tension rail 92. The links 30 and 40 have been moved to a closed extended position and the nut 66 has been tightened (rotated and moved to the left as viewed in FIG. 2D). The screen 93 has been pulled against the stop 94 and the top of the tension rail 92 has moved to abut the inner surface of the basket sidewall 91.

As shown in FIG. 2D, the pinions 32 are disposed below a line L between the pinions 22 and 42 and the surface 49 of the bar 47 of the second link 40 has stopped against the surface 37 of the bar 38 of the first link 30. Due to the "below center" position of the pinions 32, the links 30, 40 are releasably locked together. By using appropriate wrenches on the bosses 31, 41, the links may be selectively moved apart to selectively unlock them, permitting release of the screen 93 from the basket.

The size and configuration of the bolt 60, in combination with the springs 64 and the nut 66, permit adjustment of tension on the screen 93 after the links 30, 40 are moved to the closed extended position of FIGS. 2C, 2D. Alternatively, the pinions may be located and the stop surfaces of the links located so that the links meet "above center" for easier opening of the links.

Figure 7:
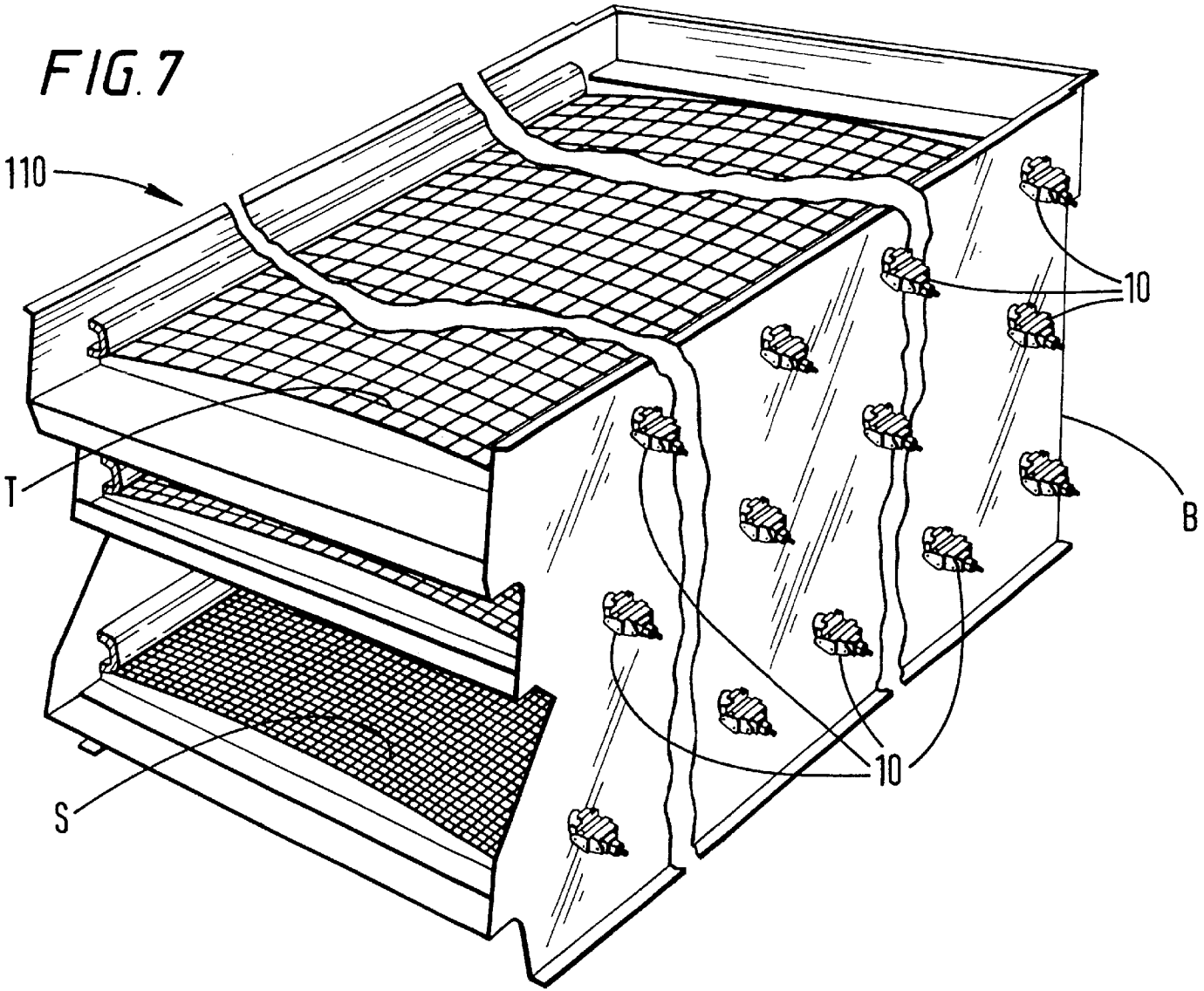
FIG. 7 is a perspective view of a vibratory screen apparatus according to the present invention.

FIG. 7 shows a vibratory separator system 110 with a plurality of apparatuses 10 according to the present invention releasably securing screens S and T within a basket B. One such a vibratory separator apparatus (with different screen securement apparatus) is disclosed in U.S. Pat. No. 4,735,712 incorporated fully herein for all purposes.

Figure 8:
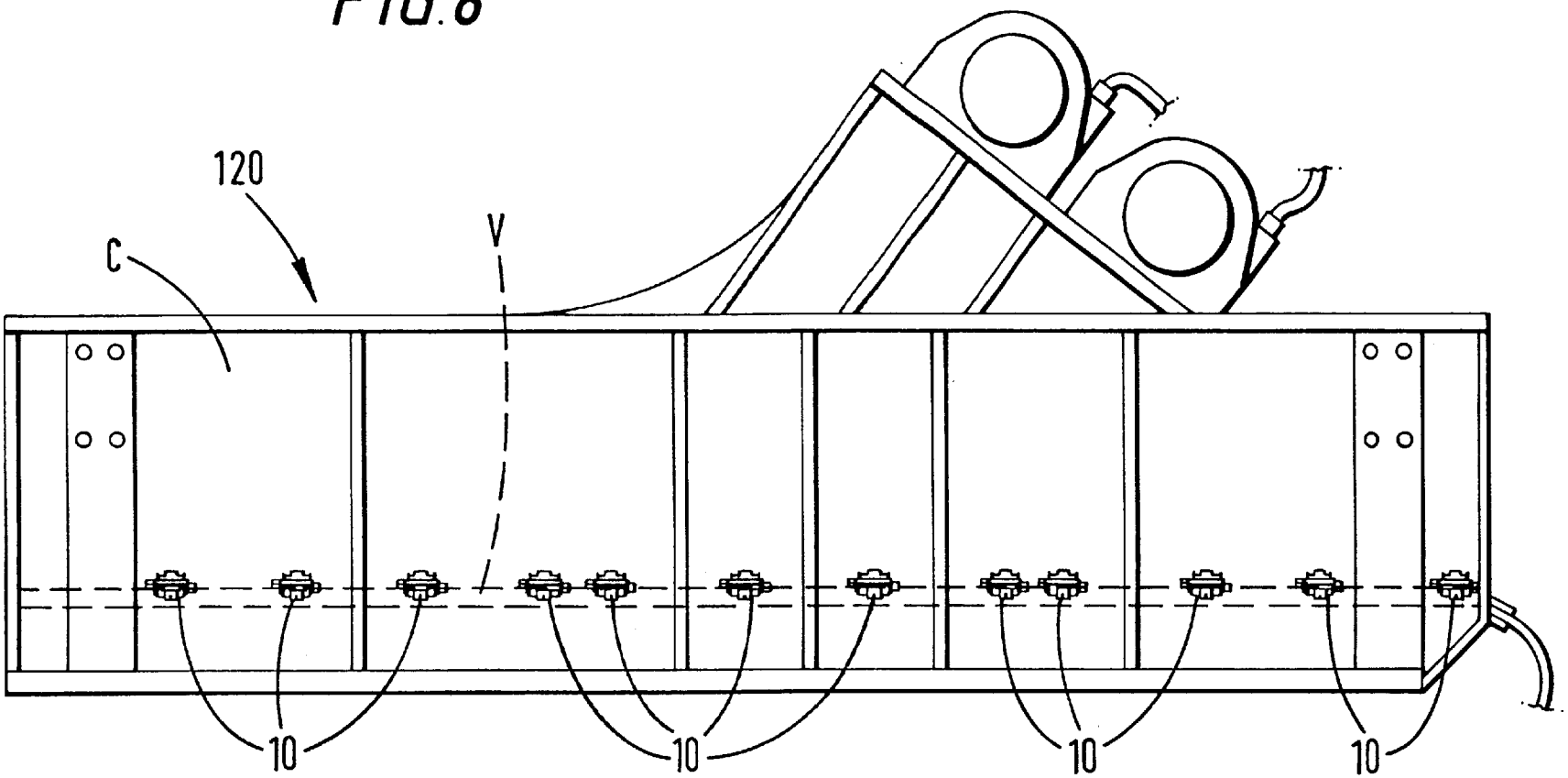
FIG. 8 is a perspective view of a vibratory screen apparatus according to the present invention.

FIG. 8 shows a vibratory separator system 120 with a plurality of apparatuses 10 according to the present invention releasably securing screens V within a basket C. One such a vibratory separator apparatus (with different screen securement apparatus) is disclosed in U.S. Pat. No. 4,882,054 incorporated fully herein for all purposes.

The present invention discloses, in certain aspects, a vibratory separator apparatus for separating components from a fluid material stream (e.g., but not limited to drilling fluid) fed to the vibratory separator apparatus, the vibratory separator apparatus for separating components of the fluid material stream, and heating apparatus for heating the fluid material stream. The present invention discloses, in certain embodiments, a screening system with a screen mounting basket, at least one screen mounted to the basket, at least one clamp system clamping the at least one screen to the screen mounting basket,and heating apparatus for heating the at least one screen.

Figure 9B:
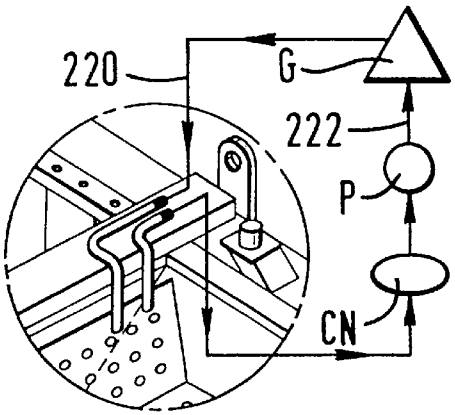
FIG. 9B is an enlargement of part of the system of FIG. 9A.
Figure 9A:
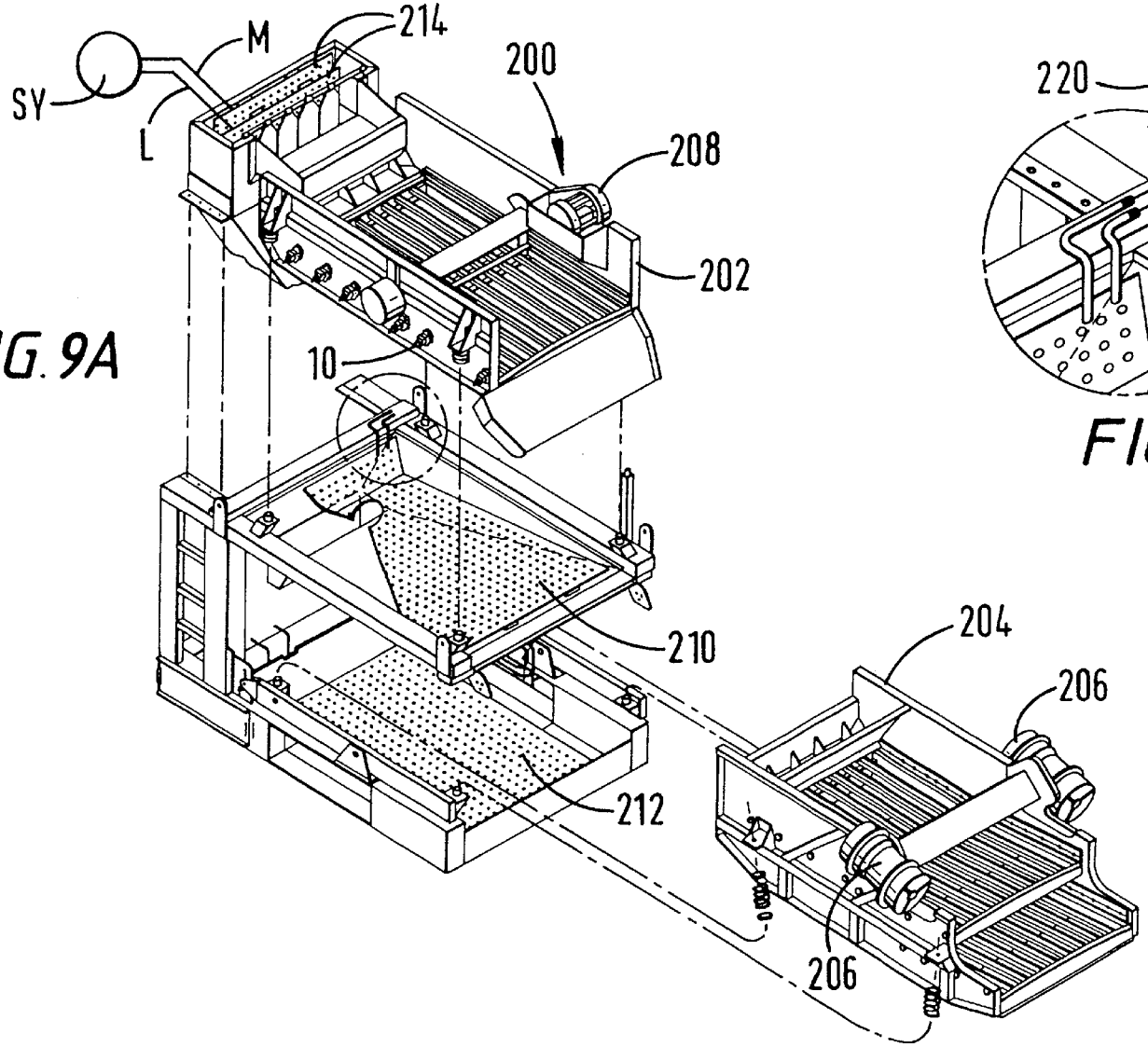
FIG. 9A is a perspective exploded view of a system according to the present invention.
Figure 10A:
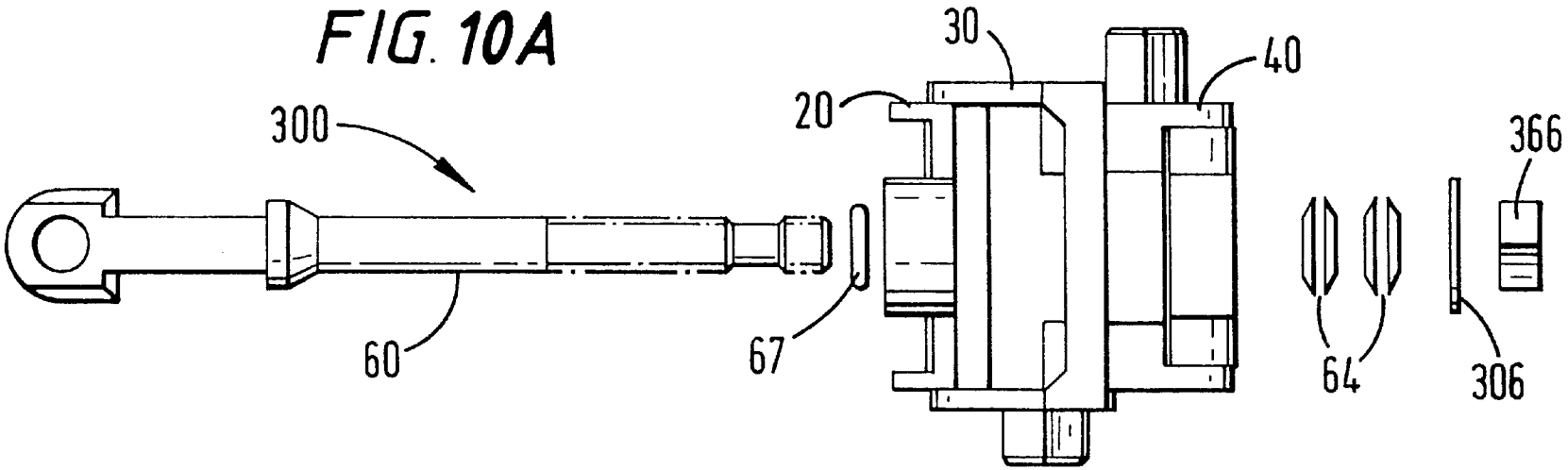
Figure 10B:
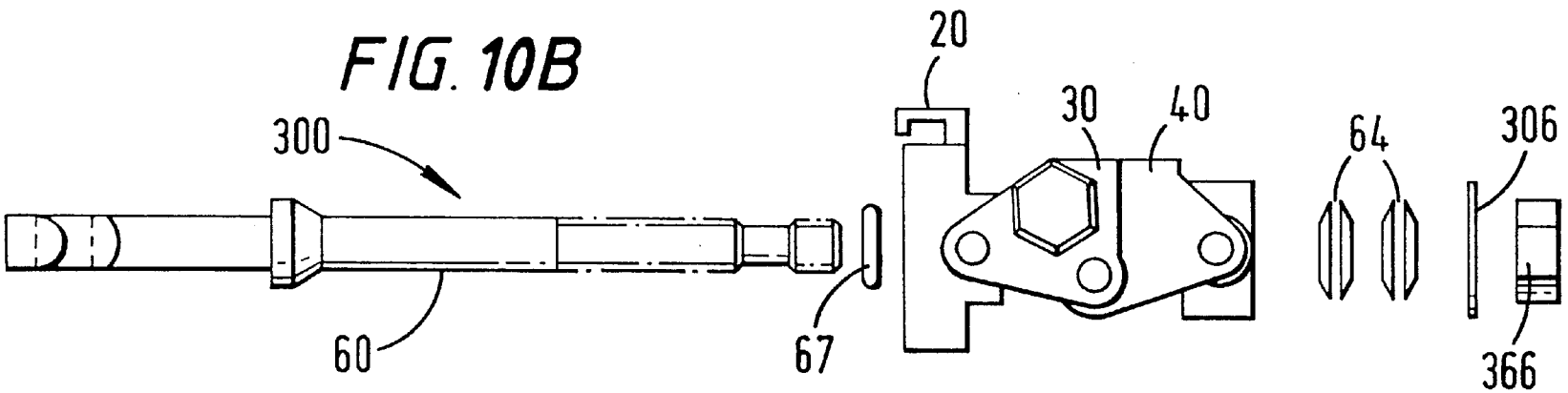

FIG. 9A shows a system 200 according to the present invention with two screen baskets 202, 204; vibrator apparatus 206, 208; heater beds 210, 212 (one under each basket); heat transfer plates 214; heated fluid supply line 220; and fluid return line 222. A plurality of clamp assemblies 10 according to the present inventions hold a screen or screens (not shown) in the baskets 202, 204. (Clamps 10 shown in place on top basket; clamps 10 connectible to, but not shown on, lower basket.) The lines 220 and 222 are connected to and in fluid communication with a heated fluid generating system, e.g. a steam boiler system G. Steam flows in a line 220 to a heat exchange bed 210. Cooled fluid is returned via the line 222 which flows to a condenser CN and is pumped by a pump P back to the system G. The bed 212 may have its own system G or it may be in fluid communication with the system G. Similarly the heat transfer plates 214 have their own system SY with supply line L and return line M, but the heat transfer plates may be tied into the system G. In one aspect the system G raises the temperature of fluid (e.g. mud) introduced to the system 200 up to at least 70° F.; in another aspect, to at least 80° F., and in a particular aspect to 90° F. or higher. Any suitable heat exchange system may be used instead of the system G.

FIGS. 10A–10E show an alternative embodiment 300 of the system 10 and like numerals indicate the same parts. The cylinder 29 of the system 10 is deleted and an area 302 for an O-ring 67 is larger than the recess 23 of the system 10. A ridge 304 encircles the area 302. A washer 306 is used with a nut 366.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A vibratory separator system for separating components from a liquid-solid mixture containing drilling mud fed to the vibratory separator system, the vibratory separator apparatus comprising a plurality of screen baskets, each screen basket with at least one screen for treating the liquid-solid mixture containing drilling mud for separating components thereof, vibrating apparatus for vibrating the screen baskets, each screen basket having a heater bed therein, a heating system for heating each heater bed for heating the liquid-solid mixture containing drilling mud, and heater apparatus comprising a plurality of heat transfer plates for heating the liquid-solid mixture containing drilling mud, and the heating system including a steam boiler apparatus and heat exchange apparatus in heat exchange relation between the steam boiler apparatus and each heater bed and the heat exchange apparatus in heat exchange relation between the steam boiler apparatus and at least one screen in each screen basket.

2. A vibratory separator system for separating components from a liquid-solid mixture containing drilling mud fed to the vibratory separator apparatus, the vibratory separator apparatus comprising separator apparatus with at least one screen for receiving the liquid-solid mixture containing drilling mud for separating components thereof, the vibratory separator system having vibrating apparatus connected to the separator apparatus for vibrating the at least one screen, heating apparatus for heating the liquid-solid mixture containing drilling mud, the heating apparatus comprising a plurality of heat transfer plates for heating the liquid-solid mixture containing drilling mud, and a heating system for heating the plurality of heat transfer plates, the vibratory separator system having a plurality of screen baskets, each screen basket having a heater bed therein, each heater bed heated by a heating system in heat exchange fluid communication with each heater bed.

3. The screening system of claim 2 wherein heating system includes a steam boiler heating system and heat exchange apparatus in heat exchange relation between the steam boiler heating system and the at least one screen.

4. The vibratory separator apparatus of claim 2 wherein the heating apparatus heats the fluid material to at least 70 degrees Fahrenheit.

5. The vibratory separator apparatus of claim 2 wherein the heating apparatus heats the fluid material to at least 90 degrees Fahrenheit.

* * * * *